United States Patent [19]

Barela et al.

[11] Patent Number: 4,730,823

[45] Date of Patent: Mar. 15, 1988

[54] ADAPTIVE DOCUMENT FEED PICK MECHANISM

[75] Inventors: Daniel A. Barela, Boulder; Mark A. Beran, Niwot; Louis A. Bustamante, Berthoud; Cecil M. McDonald, Longmont; Ronald E. Reese, Boulder; Roger D. Shepherd, Rollinsville, all of Colo.

[73] Assignee: International Business Machines Corporation, Armonk, N.Y.

[21] Appl. No.: 935,886

[22] Filed: Nov. 28, 1986

[51] Int. Cl.[4] ..... B65H 3/08

[52] U.S. Cl. ..... 271/31; 271/103; 271/155; 271/162; 414/118

[58] Field of Search ..... 271/11, 12, 31, 38, 271/130, 110, 111, 117, 118, 103, 104, 107, 108, 152, 153, 154, 155, 162, 258, 264, 265; 414/118, 121

[56] References Cited

U.S. PATENT DOCUMENTS

| | | | |
|---|---|---|---|
| 3,410,550 | 11/1968 | Weidman et al. | 271/31 X |
| 3,446,496 | 5/1969 | Schwebel | 271/155 X |
| 4,382,593 | 5/1983 | Beran et al. | 271/103 X |
| 4,480,826 | 11/1984 | Kaneko | 271/103 |
| 4,566,684 | 1/1986 | Gysling | 271/153 X |
| 4,624,454 | 11/1986 | Grutzmacher et al. | 271/153 X |

*Primary Examiner*—Joseph J. Rolla
*Assistant Examiner*—Edward S. Ammeen
*Attorney, Agent, or Firm*—Carl M. Wright

[57] ABSTRACT

Sheet feeder having adaptive mechanism for assuring dependable automatic operation when the stack of sheets to be fed consists of sheets having varying thicknesses and weights. In a sheet feeder having pickers to move a document from the top of a stack of sheets supported by a moveable table to a feed-in position, the latter possibly including a vacuum belt for moving the document, sensors supply signals to indicate a sheet has been picked. After moving the pickers and table to initial positions, the controller moves the picker to a predetermined reference position. If a sheet is picked above or below the predetermined initial position, the position of the table is adjusted accordingly. In a second embodiment in a recirculating automatic sheet feeder, the table is initially positioned then after feeding the sheets from the stack once, it is initialized at a second predetermined position depending on the number of documents in the stack and on the position of the table prior to picking the documents a second time.

10 Claims, 4 Drawing Figures

ADAPTIVE DOCUMENT FEED PICK MECHANISM

DOCUMENTS INCORPORATED BY REFERENCE

The subject matter of U.S. Pat. No. 4,382,593 (assigned to the same assignee) is hereby incorporated by reference to show examples of vacuum pickers and belts for picking and feeding sheets one at a time from the top of a stack of sheets to a utilization device.

BACKGROUND OF THE INVENTION

1. Field of the Invention

This invention relates to automatic document, e.g., paper sheet, feeder mechanisms, and particularly to automatically adaptable document feeders for reliable feeding of nonhomogenous, nonuniform stacks of documents.

2. Description of Related Art

Feeding sheets from the top of a vertically oriented stack of sheets using suckers or vacuum suction cups and puffer air is well known in the art. For example, U.S. Pat. Nos. 3,218,062 and 4,382,593 both show the use of a blow pipe or puffs of air to separate the top sheets of the stack, especially the top sheet, and vacuum pickers to provide reliable feeding of the top sheet only.

The '062 patent also includes a moveable, cam-operated feeder which is mechanically connected to the moveable vacuum suckers and the moveable blow pipe so that these elements are optimally positioned relative to the top of the stack.

The '593 patent uses a separator or restraining mechanical finger in the form of wires which act to hold down the top sheet's leading (or feed) edge as the sheet is elevated by the puffer air. In this way, the short wire members establish the pick-up zone for the feeder's suction cups. In addition, once the top sheet is vacuum attached to the suction cups, the cups move vertically upward to deliver the sheet to the lower horizontal surface of a vacuum transport belt.

U.S. Pat. No. 3,642,272 shows a device for separating the top sheet of a stack from the underlying sheets by use of a blower nozzle and suction means. In this patent, the top of the stack is sensed and a stack elevator is thereby controlled to maintain the stack's top sheet at a desired position to feed the picked sheet into fixed pinch rollers.

U.S. Pat. No. 4,566,683 teaches the controlling of the puffer air to vary the quantity in accordance with the weight or pressure of the documents on the table.

These prior art document picking devices can be adjusted to operate fairly dependably when the document in the stack have the same dimensions thickness, and weight, i.e., the document stack is homogenous, uniform, and predictable. Nonhomogeneity of the document stack can also result from variations in the lengths and widths of the documents to be fed even if the document are of the same thickness and weight. Such feeders, however, become less reliable and even inoperable when the document stack is nonhomogenous and nonuniform. The characteristics of individual documents in the stack are no longer predictable resulting in document behavior that hinders or prevents dependable feeder operation. For example, heavy documents may not be moved high enough by the puffer air for the picker mechanism to attach them. Light weight documents may be moved higher than practical for good operation.

SUMMARY OF THE INVENTION

The document feeder of this invention provides a unique combination of controlled movement of the pickers, initial table positioning and dynamic adjustment, sensing of the picking operation, and mechanical feeder implementation to provide an adaptive feeder having a document feeding operation that automatically adjusts as needed to accommodate varying document stack heights and the variability of individual document characteristics, and including the ability to retry a document pick where an initial attempt has failed.

According to the invention, a stack of sheets to be picked one at a time from the top of the stack is supported by a moveable table. The pickers are positioned at one reference position and the table is moved to an initial table reference position. The pickers are moved down one step at a time—where a step is some small increment of distance—toward a second reference position. When a sheet has attached to the pickers, it is moved to a transporting device, such as a vacuum belt. A sensor supplies a signal indicating that a sheet has attached to the pickers.

If the pickers reach the second reference position without attaching a sheet, they continue to be moved past the second reference position, one step at a time, for a fixed number of steps. If a sheet attaches to the picker before the fixed number of steps have been moved, the operation continues as above. If not, the pickers dwell at the last position awaiting attachment. If no attachment occurs after the dwell period, the table is moved up to place the top document nearer the pickers. If no attachment then occurs, an error is indicated.

As an added feature, if a sheet attaches before the pickers reach the second reference position, the table is moved down a preset distance, and the operation continues.

The foregoing and other features and advantages of the invention will be apparent from the following more particular description of preferred embodiments of the invention, as illustrated in the accompanying drawing.

BRIEF DESCRIPTION OF THE DRAWING

The invention is described in detail by referring to the various figures which illustrate specific embodiments of the invention, and wherein like numerals refer to like elements.

DESCRIPTION OF THE PREFERRED EMBODIMENT

Although described in detail as applied to a recirculating automatic document feeder with vacuum operated pickers, no limitation thereto is implied or intended.

Figure 1:
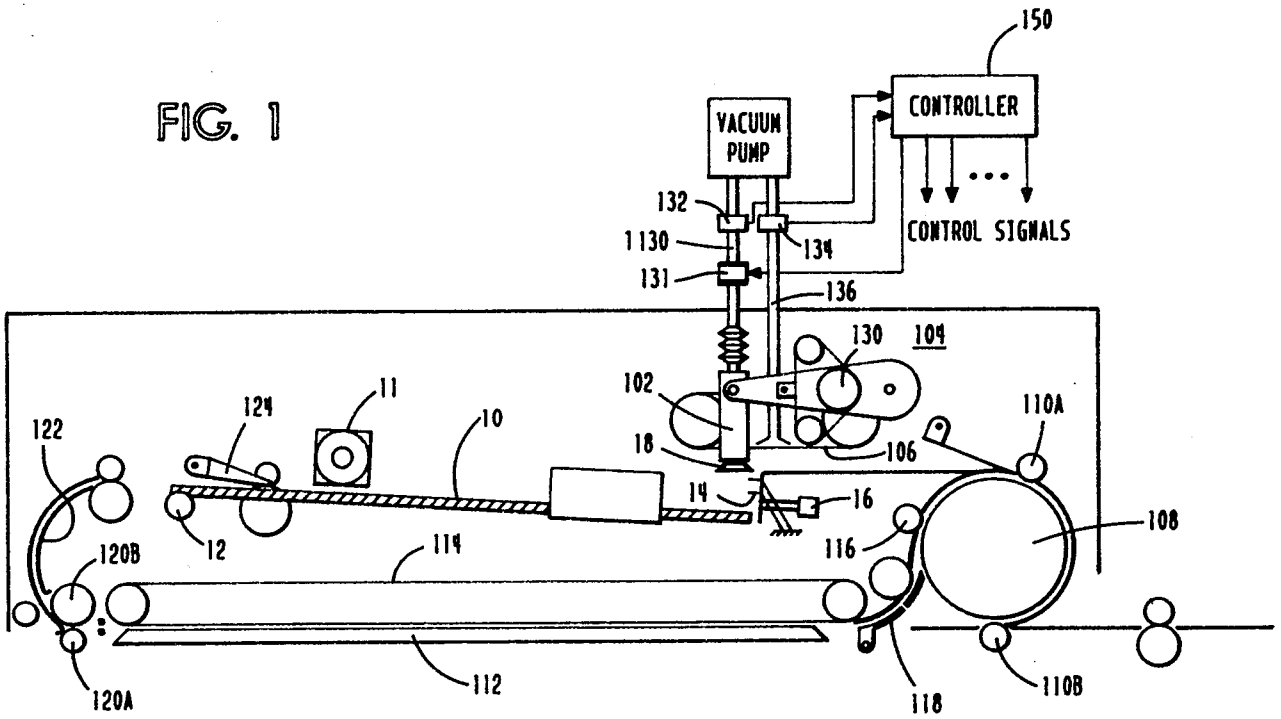
FIG. 1 is a schematic representation of the principal elements of a picker mechanism as used in accordance with the invention.

FIG. 1 is an illustration of the principal parts of a document feeder such as may be used in copiers or duplicator machines. A document table 10 supports a stack of documents to be copied and can be adjusted up and down by movement about a pivot point 12 by a stepper motor 11. The front of the table 10 is raised so that the top documents come to rest against restraining wires 14 and are separated from one another by puffer air from a blower 16. The pickers 102 have suction cups 18 on the bottom and are moveable vertically by a mechanism 104 including a stepper motor 130. When the table 10 is initially raised and positioned, the pickers 102 are lowered until the suction cups 18 attach to the top sheet of the stack of documents on the table 10. The pickers 102 are then raised by the mechanism 104 until the document attached to the suction cups 18 is attached to a vacuum belt 106.

The pickers 102 are then disengaged by cutting off the vacuum and moving them upward past the vacuum belt 106. The document is moved onto a document glass 112 for copying via a rotating drum 108, pinch rollers 110A and 110B, and a second vacuum belt 114. When the document on the document glass 112 has been copied, it is driven in one of two directions. If the reverse side of the document is to be copied, i.e., in duplex copying, the document is driven by the second vacuum belt 114 onto the drum 108 through other pinch rollers 116 as directed by a guide 118, shown in the up position and which is in a down position when initially feeding a document. The document is passed around the drum 108 onto the document glass 112 to enable copying of the reverse side.

When copying of the document is completed in a recirculating document feeder, it is driven by the second vacuum belt 114 into pinch rollers 120A and 120B and through a guide channel 122. A restack mechanism 124 raises the document stack to enable the returning document to be moved under the bottom of the stack.

Details of such document feeder devices are shown in U.S. Pat. No. 4,382,593 incorporated herein by reference. The problems of initially positioning the table 10 and the pickers 102 to assure proper operation when documents of different thickness and weights are mixed in varying stack sizes on the table 10 are overcome by an adaptive procedure controlled by a properly programmed microprocessor. A controller 150 includes the microprocessor and microcode to execute the algorithm, to receive signals from sensors, and to supply control signals to stepper motors that regulate, inter alia, the table position and the position of the pickers 102.

When the system is powered on, the controller 150 has no stored values indicating the positions of the table 10 or the pickers 102. To provide a reference position, the table 10 is driven downward onto a hard stop and the pickers 102 are driven upward onto hard stops. The table 10 and the pickers 102 are thereby positioned at home positions.

After documents are placed on the document table 10 and a feed operation is initiated, an initialization procedure is invoked. The pickers 102 are moved down 28 steps, the puffer air source 16 is turned on, and the table 10 is moved up a minimum of 25 steps. When the top document is attached, a vacuum sensor 132 is activated. Movement of the table 10 is stopped and the pickers 102 are moved up to the upper most reference position. The document feed process is then ready to begin.

In actual practice, heavy documents may not move up as high as the lower restraining wires 14 and light documents may be blown past them to the upper restraining wires.

In the actual feed process, it is assumed that the stack of documents will be of a height that the top sheet will be picked when the vacuum pickers are lowered a predetermined number of steps, twenty-four in the following description, by its stepper motor. At this position, the vacuum pickers 102 are at the approximate vertical position of the lower restraining wires 14.

In a second embodiment, the table is moved to one of a plurality (two will be described) of default positions, for a normal and for a small set which will be described in more detail below.

In the first embodiment, a sensor 132 in the vacuum line 1130 to the pickers 102 detects that a document has been attached to the suction cups 18. Such sensors are well known in the control art. The increase in vacuum that occurs when a document attaches to the suction cups 18 can be sensed by a diaphragm in the sensor 132 that operates against an appropriate counterforce to close a switch. The sensor 132 supplies a signal SPU to the controller 150 that a sheet has been attached.

If the controller 150 does not receive the SPU signal, the pickers 102 are moved down one step. If, after a short delay, no SPU signal is received indicating a document has not attached to the cups 18, the pickers 102 are again moved down one step and the above procedure repeated. If a predetermined number of attempts, moving down one step for each attempt, to attach a document are made without success, the table 10 may be stepped up, one step at a time, until the sensor 132 supplies the SPU signal to the controller 150 that a document has attached to the suction cups 18 on the pickers 102.

In the embodiment being described, the reference point, 104 table steps, to which the table can be raised is considered to be the maximum allowable. Therefore, the failure of a document to attach after the predetermined number of attempts is treated as an error condition which is handled by a separate program routine.

In response to the SPU signal, the pickers 102 are then moved up a certain number of steps so that the attached document attaches to the vacuum belt 106, which is signaled by a sensor 134 in the vacuum line 136 to the vacuum belt 106. The signal supplied by the sensor 134 is denoted as BOP. The vacuum to the pickers 102 is then cut off by a control valve 131 in response to a control signal from the controller 150. The document is then carried to the feeder mechanism as described above for placement on the document glass 112.

The controller 150 may or may not be the same controller that controls the machine to which the described feeder is attached. If it is, then it will include a procedure to sense when the unsuccessful picking attempts have taken so much time that a document will not be placed on the document glass 112 in time to be copied and to force the copier into a skip cycle and retry mode. If the controller 150 is not the associated machine's main controller, then the controller 150 will supply a signal to the main controller so the latter can initiate a skip cycle process.

For light weight documents, the table 10 may be too high. If the sensor 132 indicates that a sheet has attached to the suction cups 18 before the cups have reached the level of the lower restraining wires 14, then the table is moved down a fixed number of steps. This procedure is repeated for each successive pick operation with the result that the table 10 will be correctly positioned. It is kept in the correct position by stepping the table up when necessary. After a predetermined number of documents have been successfully picked (two in the following explanation), the table is moved up a given number of steps, usually one. This is an additional capability not shown in the described implementation.

In a second embodiment, the table 10 is moved to a default position if the table is not moved to a proper operating position after picking the entire stack of documents once. After the documents have been picked once, the controller has a count of the number of documents. For a second copying of the documents, if required, the table is moved to a default position if the document count is less then some threshold value, e.g., six, and if the table has not been adjusted to at least the default position.

This control procedure will now be described in detail with references to the flowcharts of FIGS. 2, 3, and 4. For ease and clarity of explanation, the procedures are described as subroutines callable by the master control program which usually will include control modules for the feeder mechanism and copier.

A master control program controls the height of the document table by sending commands and by controlling flags that are used by the table height initialization subroutine.

Table height adjustments are also controlled by the pick sheet function subroutine. Typically, the master control program will be executed on a central microprocessor and the table height initialization and pick sheet function subroutines on a controller microprocessor dedicated to controlling the document feeder.

The central processor issues commands to the document feeder processor and waits for feedback indicating the commands have been executed. When the document feeder processor determines independently that table adjustment is required and changes the table's position, feedback is supplied to the master control program so that it can update current position values maintained in a nonvolatile memory. Continuous tracking of the table position provides flexibility in height control.

When conditions require that the table be homed, i.e., driven to its full down position, e.g., at machine power up, the master control program first determines the table's current position by fetching the information previously stored in the nonvolatile memory. In the embodiment being described, the maximum table position away from home should never exceed 104 steps. A check is made to determine whether the value fetched is within the allowable range before issuing a command to the document feeder processor that will drive the table down a number of steps equal to the fetched value plus four. The overdrive (extra four steps) provides protection against cumulative step errors inherent in systems of this type. Homing the table by simply commanding the document feeder processor to move the table down a fixed number of steps, e.g., 120 regardless of its position, even when the table was already down, causes the mechanism to rattle against a hardware stop the entire time, causing objectionable and otherwise unnecessary noise. In this implementation, the table is moved down only the number of steps required to assure that it is indeed at its home position.

Since the size of the stack is not known at the start of each job, it is not possible to determine the validity of the initialization point. Therefore, the job is allowed to start regardless of the table's height after initialization is complete. The master control program monitors the document feeding until the first END OF STACK (EOS) is detected. Then it determines whether any corrections are required based on two conditions. First, the number of originals must be less than some specified number, six in the described implementation. Second, the final table position, indicated by the value of FTC, sent back by the table height initialization subroutine during the initialization process, is compared to an estimated value, e.g., 62 in the implementation being described. If the table is not at step 62, then the master control program causes the table height adjustment subroutine to move it there. This places the table at an operating position that prevents jams and allows other functions, including other table height adjustment algorithms with greater resolution, to operate correctly.

Figure 2:
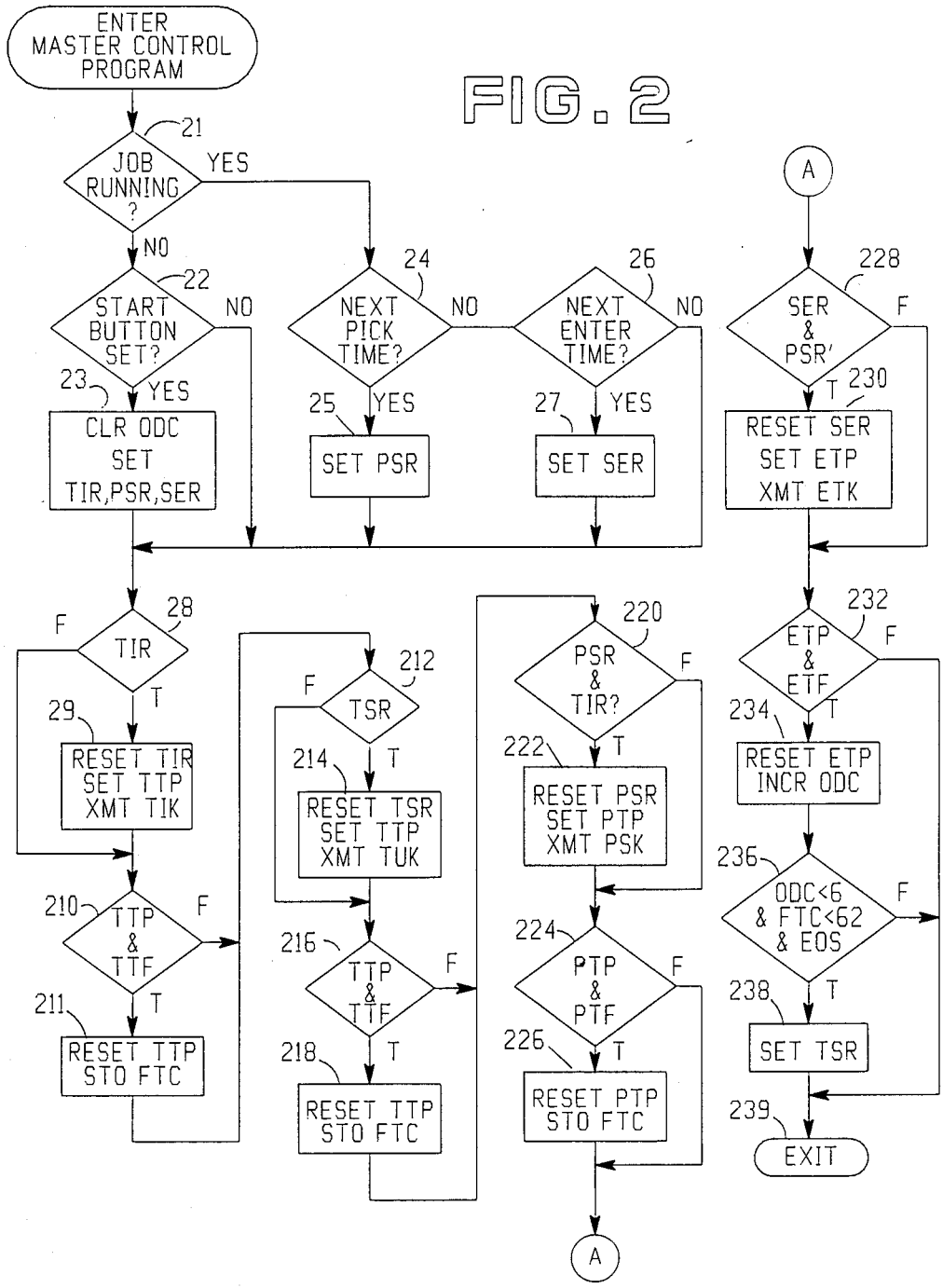
FIG. 2 is a flowchart depicting a master control program portion related to the invention.

The program represented by the flowchart of FIG. 2 is the part of the master control program relevant to the document feeder according to the invention and is executed about every 32 milliseconds.

The following abbreviations are used in the flowcharts:

| | | |
|---|---|---|
| BVO | Boot Vacuum On | Flag |
| EOS | End Of Stack | Flag |
| ETF | Entry Task Feedback | Flag |
| ETK | Entry Task Command | Signal |
| ETP | Entry Task in Progress | Flag |
| FTC | Feedback Table Count | Value |
| ODC | Original Documents Counter | Value |
| PCT | Pick Count (steps moved) | Value |
| PE1 | Pick Subroutine Entered Once | Flag |
| PFS | Pick Failure Status | Flag |
| PHR | Picker Home Request | Flag |
| POB | Paper on Belt | Flag |
| PSK | Pick Sheet Command | Signal |
| PSR | Pick Sheet Request | Flag |
| PTF | Pick Task Feedback | Flag |
| PTP | Pick Task in Progress | Flag |
| SER | Sheet Enter Request | Flag |
| SIS | Sensor Invalid Status | Flag |
| SPU | Sheet Picked Up | Flag |
| STT | Step Timer | Value |
| TIF | Table Initialization Failure | Flag |
| TIK | Table Initialization Command | Signal |
| TIR | Table Initialization Request | Flag |
| TE1 | Table Initialization Subroutine Entered Once | Flag |
| TSP | Table Step Position | Value |
| TSR | Table to Step 62 Request | Flag |
| TTF | Table Task Feedback | Flag |
| TTP | Table Task in Progress | Flag |
| TUK | Table to Step 62 Command | Signal |

The abbreviated elements are flags, signals, or values. A flag is a logical variable having a value of TRUE (T) or FALSE (F). In some systems, it may be handled as an integer having a value of 1 if true or set and a value of 0 if false or reset. A value is a representation of some quantity such as the contents of a counter. A signal is an electrical signal sent from an output port of the processor, commonly using a processor command such as OUT or WRITE, and coupled to a device that is activated by some certain value of the signal or remains inactive if the signal is some other value. A command may also be a flag sensed by some other portion of the control program to determine whether or not to execute a given operation.

The master control program shown here is only a part of a larger program that controls the overall operation of the copier in which the invention is used. The part controlling and responding to the document feeder of the invention is shown and described. That part of the master control program to be described tests certain conditions, usually flags, to determine the setting or resetting of other flags or the transmission of commands to the table height adjustment subroutines to cause the document feeder to operate according to the process of the invention. First, the setting and testing of flags by the master control program will be described followed by an explanation of the subroutine. The flags form the major communication between the programs.

The following description of the operation of the relevant part of the master control program refers to FIG. 2.

Each time the master control program is executed, the first step 21 determines whether a job is running. If not, then step 22 determines whether the start button has been activated. If so, then step 23 sets the TIR, PSR, and SER flags and clears the original document counter, ODC. If the start button is not activated, then step 23 is bypassed.

If a job is running as determined by step 21, then step 24 determines whether it is time for the next document to be picked. If so, then the pick request flag, PSR, is set in step 25. If not, then step 26 determines whether it is time for the next sheet to enter and sets the sheet enter request flag, SER, in step 27. Otherwise, the step 27 is bypassed.

After the above housekeeping process, steps 21 through 27, has completed setting the appropriate flags in accordance with the existing conditions of the machine, the control program proceeds to test the flags and usually, in response to flags that are set, causes the flag to be reset and corresponding commands to be issued. For example, in step 28, the table initialization request flag, TIR, is tested. If the flag is set, then step 29 resets the TIR flag and sets the TTP flag to indicate that a table task is in progress. Also, as shown in step 29, a table initialization command is issued. This causes the table height initialization subroutine to be executed. The flow chart for the subroutine is shown in FIG. 3 and described in detail below.

In FIG. 2, if the TIR flag is not set, then step 29 is bypassed.

Next, a combined test is performed in step 210 to determine whether the TTP flag is set and feedback relative to the table task was received, i.e., whether the TTF flag is set. If both conditions are concurrently present, then step 211 resets the TTP flag and stores the table count value parameter supplied by the subroutine performing the table task. If either tested condition is not present, then step 211 is bypassed. A combined test is usually performed by testing one flag at time. If the first flag is set, then the second flag is tested. If the second flag is set also, then the flowchart path designated T (true) is taken. If either flag is not set, then the flowchart path designated F (false) is taken. For ease of understanding, the test is shown as a combined logic test using the logical AND operator designated by an ampersand (&).

If the test is true, then the TTP flag is reset and the FTC value (table steps count) is stored. (STO designates storage of a value in the memory.) If the test is false, then step 211 is bypassed.

Next, a decision block 212 shows that the TSR flag is tested. If set, then it is reset; the flag TTP is set and the signal TUK is transmitted to the table control module to indicate that the table is to be moved. If the TSR flag is reset, then the above steps, shown in process block 214, are skipped.

A decision block 216 and process block 218 repeat the same steps as the decision block 210 and process block 211, respectively.

A decision block 220 shows a test whether the PSR flag is set and the TTP flag is reset. (A bar over a flag or variable indicates that its complement or inverse is tested; when written, an apostrophe will replace the bar, e.g., TTP' indicates the complement of TTP.) If the test results are true, then in the process block 222 the PSR flag is reset, the PTP flag is set, and the PSK signal is sent to the picker function subroutine to indicate that a sheet is to be picked. If the PSR flag is reset or if the TTP flag is set, then the step in the process block 222 are skipped.

Next, the PTP and PTF flags are tested according to the decision block 224. If both are true, then the PTP flag is reset and the FTC value is stored as shown in the process block 226. If either the PTP or PTF flag is not set, then the steps in the process block 226 are skipped.

Next, a decision block 228 calls for testing the SER flag set and the PTP flag reset. If both conditions are true, then, according to the process block 230, the SER flag is reset and the ETP flag is set. The signal ETK is transmitted to the table initialization subroutine to indicate that an entry task is to be executed. If the tested condition is false, then the process block 230 is skipped.

If the ETP and ETF flags are both set, according to a decision block 232, then the process block 234 shows that the ETP flag is reset and the document counter, ODC, is incremented. (This indicates a document has been entered.) If either the ETP or the ETF flag is reset, then the relevant portion of the master control program being described is exited via a terminal 239.

Finally, the TSR flag is set as shown in a process block 238 if the three conditions shown in a decision block 236 are each true, viz., if the EOS flag is set, if the document count, i.e., the value of ODC, is less than six, and if the table step count, i.e., the value of FTC, is less than 62. Otherwise, the relevant portion of the master control program is exited.

The significance of the operations in the above description will be clarified by the description of the subroutines for table height initialization and pick function. Next, the table height initialization subroutine will be described with references to FIG. 3. The program represented by the flowchart of FIG. 3 is part of the control program that is executed every four (4) milliseconds by a separate processor dedicated to document feeder operations.

When the table height initialization subroutine is entered as a result of the TIK command as shown in FIG. 2 with respect to the master control program, a decision block 31 determines whether the TE1 flag is set. If TE1 is not set, indicating that this is the first time the subroutine has been entered, then the TE1 flag is set as shown by a process block 33, thereby preventing the execution of the program steps 33, 35, 37, 39 on subsequent four (4) millisecond calls of the subroutine during the table initialization process.

After setting the TE1 flag, the SPU signal is sensed (decision block 35) to determine whether a sheet has been picked up. As described with reference to FIG. 1 above, the SPU signal originates in the sensor 132 (FIG. 1) and indicates that a sheet is on the pickers. When the subroutine is entered with the TE1 flag reset, the SPU signal should not be active since the vacuum is not turned on at the time of the test in decision block 35. Therefore, if the SPU signal is sensed at decision block 35, the SIS flag is set to indicate that the sensor is in an invalid state. The TE1 flag is reset because the table task is aborted. The last two actions are shown in a process block 37.

The SIS flag will be sensed by an error check portion of the master control program and appropriate action taken; the details of such error routines are standard and not important to an understanding of the invention.

If the test of the SPU signal in the decision block 35 shows that the signal is inactive, then the picker and table stepper motors are turned on, the STT value is set to three, and the boot vacuum is turned on as shown in a process block 39. The STT value is sensed in the subroutines at various points to cause the table height initialization subroutine to be entered a given number of times before certain actions are taken. This provides necessary delays that enable mechanical operations, slow with respect to the execution of the program, to be completed.

The next time the table height initialization subroutine is entered, the TE1 flag should be set and the BVO flag is tested according to decision block 311 to determine whether the boot vacuum has been turned on. If the boot vacuum is on, the table height is tested as indicated by the number of steps, i.e., the contents of the FTC counter, to be greater than 24 (decision block 313), then the SPU is checked in decision block 315. If a sheet has been picked up or the sensor indicates that a sheet has been picked up, then the boot vacuum is turned off and the subroutine exited. If the SPU flag is not true in the test in decision block 315, then the height of the table is checked according to the decision block 319 to determine whether it is at the maximum height as indicated by the FTC value being equal to 104. If the table is at maximum height, then the boot vacuum is turned off, the TIF flag indicating an initialization failure is set, and the TE1 flag is reset thereby allowing proper subroutine entry on the next table initialization command, all these steps being shown in a process block 321.

If either the FTC value is not equal to 104 in the decision block 319 or is less than 24 in the decision block 313, which combinations indicate that the table is within its operating range, then the STT value is checked for zero in a decision block 323. If the STT value is zero, then the flowchart path to this point has been covered three times previously because of the original setting of STT to three in the process block 39. If the STT value is not equal to zero, then it is decremented as shown in process block 333. Otherwise, the steps in the process block 325 are executed, setting the STT value to three, stepping the table up one step, and incrementing the FTC value.

The pick count value, PCT, is checked in the decision block 327 to determine whether it is equal to 28. If so, the pickers are at the full down position and the subroutine is exited. Otherwise, as shown in a process block 329, the PCT value is incremented and the pickers are stepped down one step. The PCT value is the number of steps that the pickers have been moved in the downward direction.

If the boot vacuum was not on in the test by the decision block 311, then the decision block at 331 tests whether the PCT value is equal to zero, indicating that the pickers have returned to home position. If true, then—as shown in a process block, 336—the motors are turned off, the TE1 flag is reset, the TTF flag is set, and the signal FTC is transmitted. Following this action, the subroutine is exited.

If, in the decision block 331, the test determines that the PCT value is not equal to zero, then the value of STT is tested for zero as shown in a decision block 337. If zero, then the STT value is set to three, the pickers are moved up one step, and the PCT value is decremented as shown in the process block 339. If the STT value is not zero, then it is decremented by one as shown in a process block 341.

Figure 3:
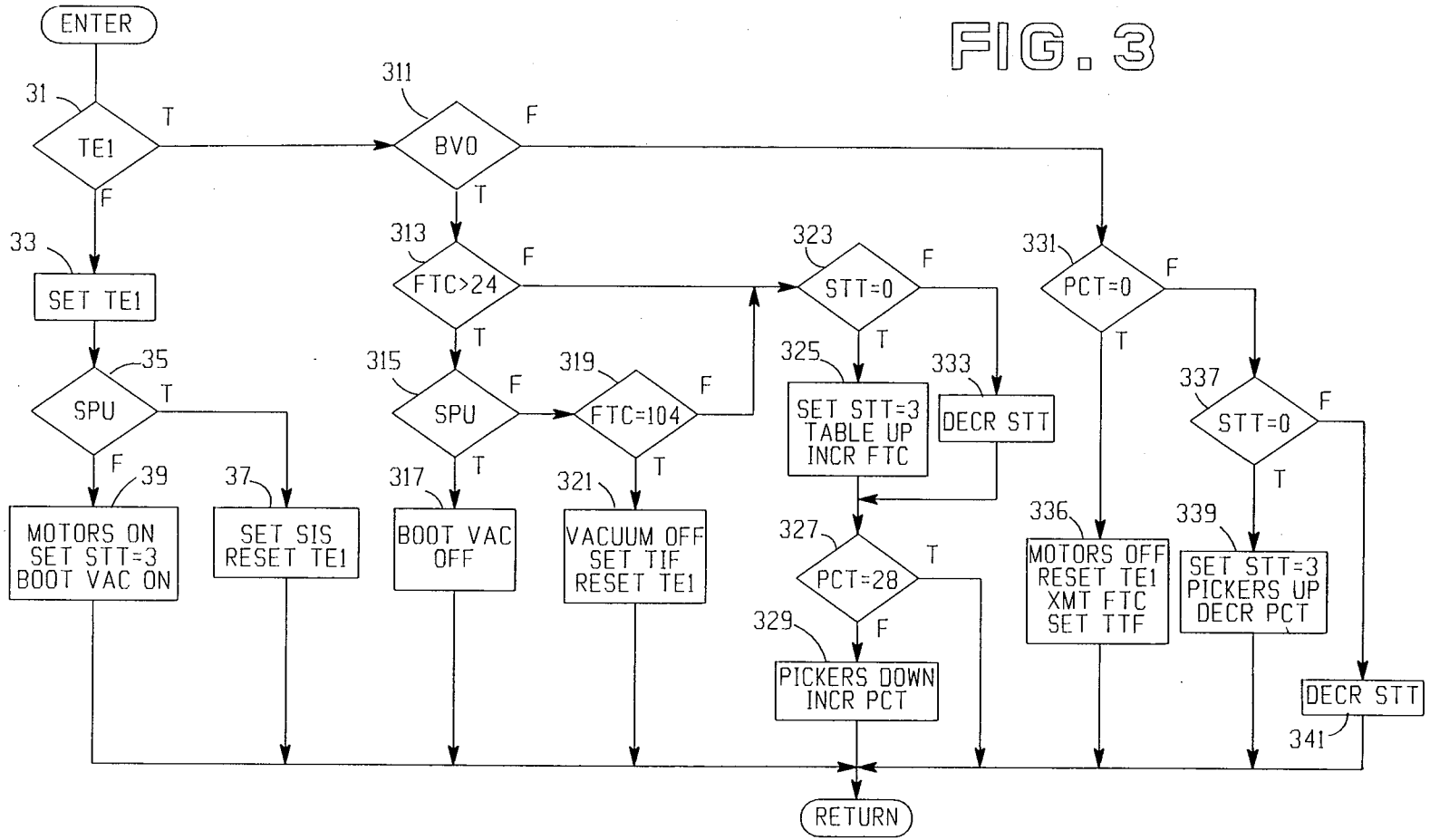
FIG. 3 is a flowchart of a table height initialization subroutine operating according to the invention.

The table height initialization subroutine as shown in FIG. 3 causes the document table to be stepped up to an initial position whereby the first sheet can be dependably picked off the top of the document stack.

Figure 4:
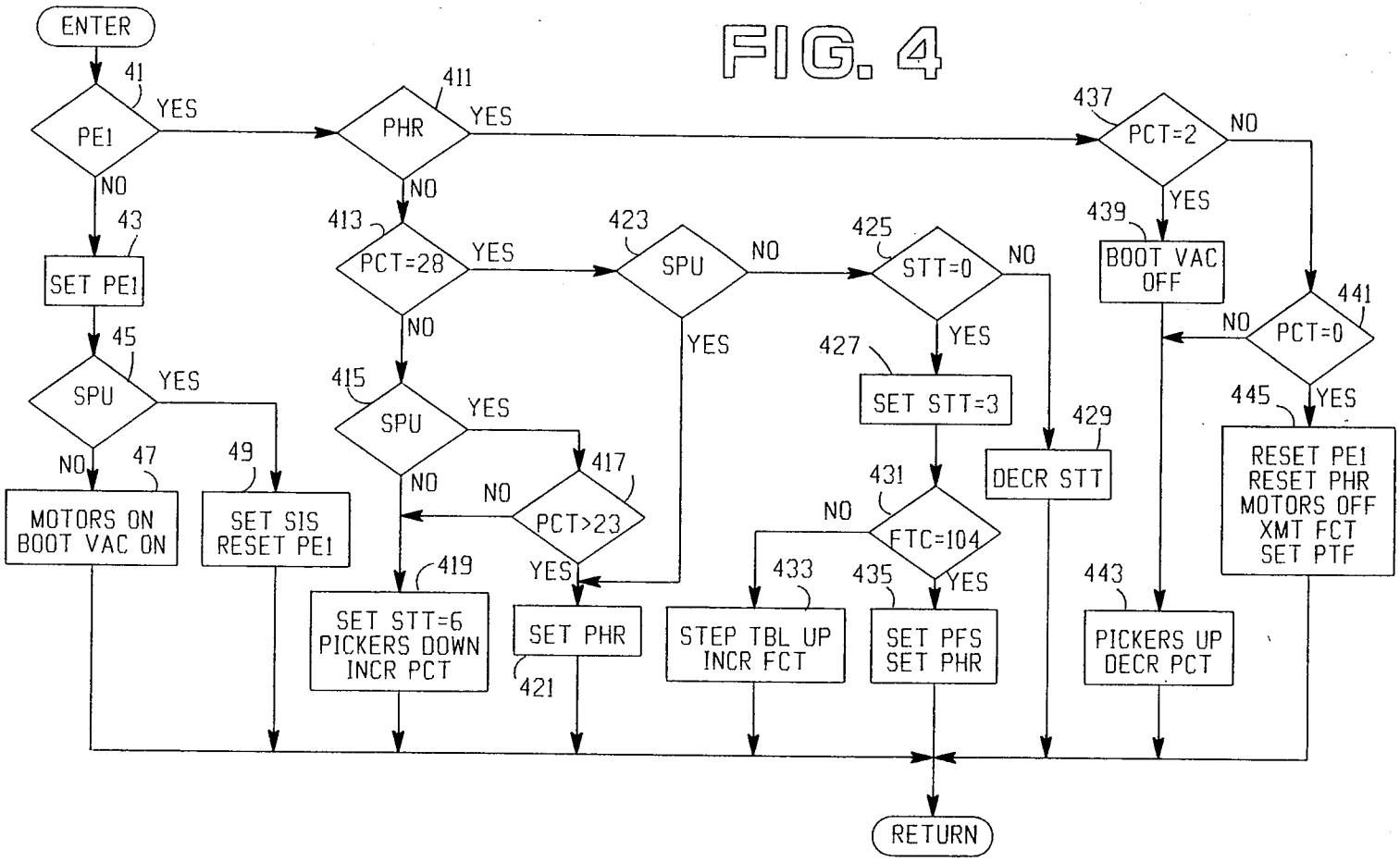
FIG. 4 is a flowchart of a pick function subroutine operating according to the invention.

When the table has been successfully moved to its initial height and the master control program determines that a sheet is to be picked, the pick function subroutine, illustrated in FIG. 4, is entered. The program represented by the flowchart of FIG. 4 is part of the control program that is executed every four (4) milliseconds by a separate processor dedicated to document feeder operation.

The first step determines whether the PE1 flag is set as shown in a decision block 41. Initially, the flag will not be set and the program will proceed to a process block 43 where the PE1 flag is set. The SPU flag is tested at decision block 45 for the same reason as discussed in relation to FIG. 3 decision block 35, and similar actions are taken. If the SPU flag is reset indicating that a sheet has not been picked up, then—as shown in process block 47—the picker motors and the table stepper motors are turned on as is the boot vacuum. If the SPU flag is set, indicating that a sheet is picked up then, as shown in process block 49, the SIS flag is set and the PE1 flag is reset.

When the subroutine is entered with the PE1 flag set, the PHR flag is checked to determine whether other portions of the program have requested that the pickers be driven to the home position, as shown in decision block 411. If the PHR flag is reset, as it should be when the test is first made, the pick count, equal to the number of steps that the pickers have been moved down from their home state, is checked for a value of 28 as shown in a decision block 413. A pick count of 28 indicates that the steppers have been moved the maximum number of steps.

If the picker count, PCT, is not 28, then a test is made to determine whether a sheet has been picked, i.e., SPU flag set, as shown in a decision block 415. If no sheet has been picked, the STT (step-through-times value) is set to six, the pickers are stepped down and the pick count is incremented. (The STT valve is set to six to cause the picker function subroutine to traverse six times, providing time for the pickers to come into position and for a document to be attached if the settings are correct.) If a sheet has been picked up, as indicated in the decision block 415, then the pick count, PCT, is checked in decision block 417 to determine whether it is greater than 23. If not, then the steps shown in a process block 419 are repeated. Otherwise, the picker home request flag (PHR) is set as shown in a process block 421. If the pick count (PCT) was equal to 28 in the test shown in the decision block 413, then the SPU test is repeated in the decision block 423 with the true path causing the picker home request (PHR) flag to be set as shown in the process block 421. This causes a picked sheet to be transported to the vacuum belt.

In a decision block 423, if a sheet has not been picked up and the step-through-times (STT) value is equal to zero as shown in the test in a decision block 425, then the STT value is set to three and the table height is checked. If the table height is at a maximum as indicated in decision block 431 by testing the FTC count value equal to 104, then the PFS and the PHR flags are set in process block 435. Otherwise, the table is stepped up and the table count (FTC) is incremented as shown in the process block 433.

If the step-through-times (STT) value is not equal to zero, then it is decremented as shown in a process block 429 and the subroutine is exited.

If the picker home request (PHR) flag was set at the test shown in the decision block 411, then the pick count (PCT) is tested for value of two as shown in a decision block 437. If true, the boot vacuum is turned off as shown in process block 439 and the pickers are moved up one step and the pick count decremented as shown in a process block 443. These steps are also executed if the pick count test in the decision block 437 is false but the pick count is not zero as shown in a decision block 441. If the pick count test in the decision block 441 is true, then the steps shown in a process block 445 are executed, viz., the PHR and PE1 flags are reset, the motors are turned off, the FTC signal is transmitted, and the PTF flag is set.

The net result of the actions just described for the pick function subroutine is that the table height and picker height are automatically adapted so as to pick a sheet dependably from the top of the document stack on the document table. Failures to pick are indicated by the table being at a maximum height and no sheet being picked. Otherwise, the table is stepped up as required and the pickers are stepped down as required to cause the top sheet of the document stack to be picked.

An adaptive document picker has been described which maintains the document table and pickers at the correct positions to assure dependable operation independently from the characteristics of the documents on the stack.

While the invention has been particularly shown and described with reference to a preferred embodiment thereof, it will be understood by those skilled in the art that various changes and modifications in form and details may be made therein without departing from the spirit and scope of the invention according to the following claims.

What is claimed is:

1. A method of operating a sheet feeder for picking sheets one at a time from the top of a stack of sheets supported by a moveable table, and having pickers for attaching to and removing the top sheet from the stack of sheets, including stepping means for moving the pickers up or down incremental distance steps and sensor means for supplying a signal when a sheet is attached to said pickers, comprising the steps of:

placing the table at a first reference position;

positioning the pickers at a second reference position;

stepping the pickers one step at a time toward a third reference position;

moving the pickers upward with an attached sheet to a removal position in response to the sensor signal indicating a sheet is attached to the pickers;

continuing to step the pickers one step at a time past the third reference position if no sensor signal is supplied; and altering the position of the table if said signal is supplied before the pickers reach the third reference position.

2. The method claimed in claim 1 including the further step of:

ending said operation if said pickers are moved a predetermined number of steps past said third reference position and no sensor signal is supplied.

3. The method claimed in claim 2 including the further step of:

raising the table a preset distance after a predetermined number of sheets have been removed from the top of the stack.

4. The method claimed in claim 3 including the further step of:

repositioning the table to a different first reference position if the total number of sheets on the stack is fewer than a given number and the table is not already at a specified height.

5. The method claimed in claim 4 including the further steps, preceding the step of repositioning, of:

counting the number of sheets picked from the stack until all sheets have been picked; and returning each sheet to the bottom of the stack after being picked.

6. The combination comprising:

means for adjusting the height of a stack of sheets to be picked one at a time from the top of the stack for feeding into a utility device;

picker means for attaching a top sheet from said stack, said picker means including sensor means for supplying an attach signal when the top sheet is attached to the picker means;

control means adapted to receive signals from said sensor means and to supply control signals for controlling sheet feeding operations;

means responsive to a control signal from said control means for moving said picker means to a reference position with respect to said stack of sheets;

means responsive to said attach signal for causing said pickers to remove said top sheet from said stack; and means for activating said adjusting means to change the position of the table if said attach signal occurs before said pickers are moved to said reference position.

7. The combination claimed in claim 6 further including:

means for creating a vacuum;

and wherein:

said picker means include suction cup means coupled to said vacuum creating means for attaching to said top sheet and having said sensor means disposed between said vacuum creating means and said suction cup means for supplying the attach signal to said control means to indicate an attaching of a sheet to the suction cups of said picker means.

8. The combination claimed in claim 7 further including:

means for determining when a predetermined number of sheets have been picked from the top of the stack; and means responsive to said determining means for altering the position of the stack when said predetermined number of sheets have been picked from the top of the stack.

9. The combination claimed in claim 8 further including:

means for replacing picked sheets at the bottom of the stack;

means for counting the total number of sheets in said stack as sheets are picked from the top of said stack; and means for repositioning the table to an initial position depending on the total number of sheets on the stack before picking said sheets a second time and on the current table position prior to picking the sheets a second time.

10. In a sheet feeder apparatus having means for adusting the height of a stack of sheets to be fed, means for producing a vacuum, picker means including suction cup means operable from said vacuum producing means for removing the top sheet from said stack of sheets, and control means for receiving and supplying signals, the improvement comprising:

sensing means disposed between said vacuum producing means and said suction cup means for supplying a signal when the vacuum changes due to the suction cups engaging a sheet;

means in said control means for moving said picker means to a reference position with respect to said stack of sheets;

means in said control means for moving an engaged sheet to a removal position in response to the signal; and means in said control means for altering the position of said stack of sheets if said signal is supplied before said picker means are moved to said reference position.

* * * * *